US008858851B2

(12) United States Patent
Yang et al.

(10) Patent No.: US 8,858,851 B2
(45) Date of Patent: Oct. 14, 2014

(54) METHOD FOR PRODUCING LOWER SIZE, HIGH TENACITY AND HIGH MODULUS POLYETHYLENE FIBER

(75) Inventors: Nianci Yang, Hunan Province (CN); Yuanjun Zhang, Hunan Province (CN); Bo Gao, Hunan Province (CN); Zhiquan Wu, Hunan Province (CN); Mingqing Lin, Hunan Province (CN); Chuanqing Wu, Hunan Province (CN); Yong Guo, Hunan Province (CN); Yunbo Zhou, Hunan Province (CN); Haijun Lin, Hunan Province (CN)

(73) Assignee: Hunan Zhongtai Special Equipment Co., Ltd., Hunan Province (CN)

( * ) Notice: Subject to any disclaimer, the term of this patent is extended or adjusted under 35 U.S.C. 154(b) by 722 days.

(21) Appl. No.: 12/671,962

(22) PCT Filed: Sep. 11, 2008

(86) PCT No.: PCT/CN2008/001606

§ 371 (c)(1),
(2), (4) Date: Feb. 3, 2010

(87) PCT Pub. No.: WO2009/039725

PCT Pub. Date: Apr. 2, 2009

(65) Prior Publication Data

US 2010/0187716 A1 Jul. 29, 2010

(30) Foreign Application Priority Data

Sep. 24, 2007 (CN) ..... 2007 1 0035822

(51) Int. Cl.

| | |
|---|---|
| ***D01D 5/16*** | (2006.01) |
| ***D02J 1/22*** | (2006.01) |
| ***D01D 5/06*** | (2006.01) |
| ***D01D 4/02*** | (2006.01) |
| ***D01F 6/04*** | (2006.01) |

(52) U.S. Cl.

CPC . *D01D 5/06* (2013.01); *D02J 1/228* (2013.01); *D01D 4/02* (2013.01); *D01F 6/04* (2013.01)

USPC ..... 264/203; 264/178 F; 264/210.7; 264/210.8; 264/211.16

(58) Field of Classification Search

USPC ..... 264/178 F, 203, 210.7, 210.8, 211.16

See application file for complete search history.

(56) References Cited

U.S. PATENT DOCUMENTS 4,938,911 A * 7/1990 Bastiaansen et al. ..... 264/204
5,032,338 A 7/1991 Weedon et al.

(Continued)

FOREIGN PATENT DOCUMENTS

CN 1160093 A 9/1997
CN 1590608 A 3/2005

(Continued)

OTHER PUBLICATIONS

European Search Report from Application No. EP 08 80 0599 dated Nov. 2, 2010.

(Continued)

*Primary Examiner* — Leo B Tentoni

(74) *Attorney, Agent, or Firm* — Wolf, Greenfield & Sacks, P.C.

(57) ABSTRACT

The present invention discloses a process for producing low-titer, high-strength and high-modulus polyethylene fibers, comprising the following steps: dissolving the ultra-high molecular weight polyethylene into paraffin oil with a low viscosity to form a spinning solution with a concentration of 3~15%; extruding the spinning solution through a thin spinneret with at least 10 orifices having a diameter ϕ of 0.7~0.8 mm and a length/diameter ratio of 10~12, by applying a high pressure in the range of 2.5±1.0 MPa to the spinning solution, such that the fluid in the orifices is extruded at a shear rate of 200~3 500 $sec^{-1}$; and then performing a jet stretch at a deformation rate of 200~5 000 $min^{-1}$ within an air-gap of 10~15 mm between the spinneret and the quench bath surface; feeding the jet-stretched fluid into the quench bath to form gel filaments; extracting and drying the gel filaments; and performing a multistage ultrahigh post stretch on the dried gel filaments with a stretch ratio of 15 or less. In this process, the solution is extruded at a high rate by using a spinneret with small orifice diameter, thereby achieving a high shear rate and a high deformation rate, so the present process is a novel and effective spinning process.

10 Claims, 1 Drawing Sheet

(56) References Cited

U.S. PATENT DOCUMENTS

| | | | | |
|---|---|---|---|---|
| 5,068,073 | A | 11/1991 | Pennings et al. | |
| 5,252,394 | A * | 10/1993 | Kouno et al. | 264/210.7 X |
| 2005/0153134 | A1 * | 7/2005 | Sasaki et al. | 428/402 |

FOREIGN PATENT DOCUMENTS

| | | | |
|---|---|---|---|
| CN | 1995496 | A | 7/2007 |
| CN | 101122051 | A | 2/2008 |
| EP | 0 064 167 | A1 | 11/1982 |
| EP | 1 643 018 | A1 | 4/2006 |
| WO | WO 2005/066401 | A1 | 7/2005 |

OTHER PUBLICATIONS

Sun, Y. et al. "Investigation on dry spinning process of ultrahigh molecular weight polyethylene/decalin solution," *Journal of Applied Polymer Science*, vol. 98, Oct. 5, 2005, pp. 474-483.

International Search Report mailed Nov. 20, 2008 from corresponding International Application PCT/CN2008/001606 mailed Nov. 20, 2008.

Yin D. et al., "Production of UHMWPE Gel Fiber," Modern Plastic Processing and Application, Jun. 1999, pp. 44-47, vol. 11, No. 3.

Liang L. et al., "Rheological Study on Ultrahigh-molecular Weight Polyethylenegel," China Synthetic Fiber Industry, Apr. 2005, pp. 27-29, vol. 28, No. 2.

Pan L. et al., "A Study of Elongational Rheological Behaviour of UHMW-Pe Gel Fiber," Journal of China Textile University, Dec. 1993, pp. 62-67, vol. 19, No. 6.

European Search Report dated Aug. 8, 2011 from corresponding European Application No. 08800599.6.

ConocoPhillips Product information sheets, White Oil, 600 N. Dairy Ashford, 2W9000, Houston, Texas 77079, two pages, dated May 2006.

* cited by examiner

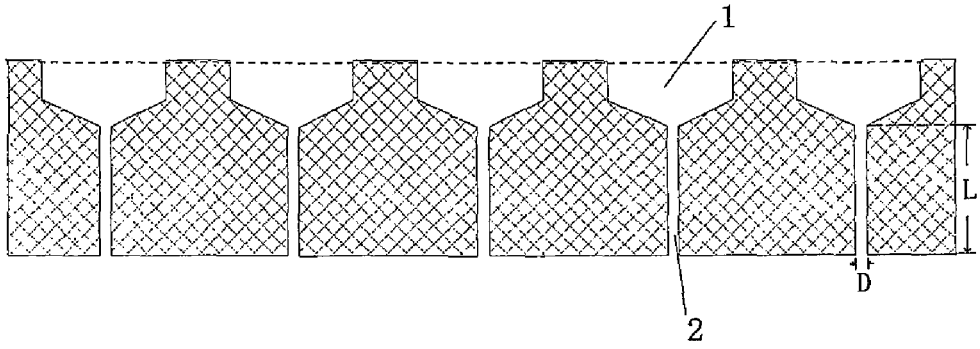
1
L
D
2

METHOD FOR PRODUCING LOWER SIZE, HIGH TENACITY AND HIGH MODULUS POLYETHYLENE FIBER

TECHNICAL FIELD

The present invention relates to a process for producing polyethylene fiber, and more specifically to a process for producing low-titer, high-strength and high-modulus polyethylene fiber.

BACKGROUND OF THE INVENTION

Since high-strength and high-modulus polyethylene fiber was produced in 1 980's, intensive study of gel spinning has been made, and it has been found that there are three key factors for producing high-strength and high-modulus polyethylene fiber by gel spinning, i.e., (1) the disentanglement of ultra-high molecular weight polyethylene (UHMW-PE) in solution; (2) the formation of a gel filament and the maintenance of the disentangled state of UHMW-PE; and (3) ultra-high-thermal stretch, resulting in high crystallinity and orientation of the macromolecular chain of PE, accompanied by the transformation of the PE crystal form. Among others, more attention has been paid to the formation of a gel filament, and actual effects have been achieved.

WO 01/73173A disclosed a process for producing high-strength and high-modulus polyethylene fiber by shear extruding a solution through a thick spinneret with an ultra length/diameter ratio (ϕ=1 mm, L/D≥40), and performing a jet stretch at an extension rate of more than 500 $min^{-1}$ and a stretch ratio of at least 5 within a narrow spin gap (where transverse air is applied). However, this process has three disadvantages, i.e., (1) the ultra length/diameter ratio of the spinneret evidently results in the increase of the flowing resistance of the fluid, so that the extruding velocity through the spinneret orifice decreases (to only 1 ml/min), and therefore the spinning efficiency is low; (2) the controllable range of the jet stretch is very narrow (≤6.4 mm), so that in the actual operation, fluctuation of the quench bath surface due to the cycling of the quench bath liquid not only influences the extension rate during the spinning, but also even cause the quench bath to reach the spinneret and thereby cause the spinning to be interrupted; (3) it is difficult to apply the transverse air at a flow rate of 0.76 m/min within the spin gap, and specifically, the transverse air at this flow rate will become insignificant when the number of the spinneret orifice increases.

WO 2005/066401A disclosed another process for producing high-strength and high-modulus polyethylene fiber, the essentials of which is the improvement of the shape of a spinneret orifice. In this process, the spinneret orifice is composed of two portions, i.e., a leading hole and a spinning hole. The leading hole has large diameter and length/diameter ratio (ϕ=3 mm, L/D=18), while the spinning hole has small diameter and length/diameter ratio (ϕ=1 mm, L/D=10), and the cone angle from the leading hole to the spinning hole is in the range of 50°~60°. The long spinneret orifice cause an increased shear stress of the solution, so that the extruded fluid can be stretched easily so as to greatly increase the extension rate of the jet stretch and the thermal stretch ratio of the gel filament, thereby obtaining high-strength and high-modulus polyethylene fiber. However, this process also has three disadvantages, which are (1) the thickness of the spinneret greatly increases due to the incorporation of the long leading hole, so the flowing resistance of the solution increases, and specifically, the maximum volume flow rate for a single orifice is only 2.2 ml/min, which is obviously disadvantageous for an effective spinning; (2) a jet stretch produces effect at a high stretch ratio (the stretch ratio of 40 in the Example 1.2), but such high stretch ratio would endanger the stretch stability; (3) if the jet stretch ratio decreases, the thermal stretch of the gel filament will become difficult in terms of both process and facility.

SUMMARY OF THE INVENTION

The present invention is accomplished in view of the above problems. An object of the present invention is to provide a process for efficiently producing low-titer, high-strength and high-modulus polyethylene fiber, which starts with the improvement of the extruding velocity of solution by using a thin spinneret with spinneret orifices of small diameter and proper length/diameter ratio. This process is cost-effective.

In the first aspect of the present invention, there is provided a process for producing low-titer, high-strength and high-modulus polyethylene fiber, comprising the following steps:

a). dissolving the ultra-high molecular weight polyethylene ($Mw=2.5\times10^6\sim5\times10^6$) into paraffin oil with a low viscosity of 6.5~7.5 to form a spinning solution with a concentration of 3~15%;

b). extruding the spinning solution through a thin spinneret with at least 10 orifices having a diameter ϕ of 0.7~0.8 mm and a length/diameter ratio of 10~12, by applying a high pressure in the range of 2.5±1.0 MPa to the spinning solution, such that the fluid in the orifices is extruded at a shear rate of 200~3 500 $sec^{-1}$; and then performing a jet stretch at a deformation rate of 200~5 000 $min^{-1}$ within an air-gap of 10~15 mm between the spinneret and the quench bath surface;

c). feeding the jet-stretched fluid into the quench bath to form gel filaments;

d). extracting and drying the gel filaments; and e). performing a multistage ultrahigh post stretch on the dried gel filaments with a stretch ratio of 15 or less.

In another embodiment, the shear rate is preferably 800~2 200 $sec^{-1}$.

In still another embodiment, the deformation rate is preferably 800~4 500 $min^{-1}$.

In still another embodiment, the air gap is preferably 15 mm.

In still another embodiment, the number of the orifices is at least 80f, and the extruding flow rate for a single orifice is 2.5~5 ml/min.

In still another embodiment, the concentration of the spinning solution is 6~10%.

In still another embodiment, the quench bath is an aqueous solution containing a cationic surfactant.

In still another embodiment, 120# Solvent Naphtha is used as an extractant for multistage extraction and drying.

In still another embodiment, the quench bath is an aqueous solution containing surfactant with the temperature being kept at 8~14° C.

In still another embodiment, the multistage ultrahigh post stretch is a four-stage stretch with a stretch ratio of 15 or less.

In some embodiments of the present invention, according to the process of the present invention, there is provided high-strength and high-modulus polyethylene fiber, which has a denier per filament of less than 2 d, a strength of more than 35 g/d and a modulus of more than 1 000 g/d. In another embodiment of the present invention, there is provided low-titer, high-strength and high-modulus polyethylene fiber, which has a denier per filament of less than 1.5 d, a strength of more than 38 g/d and a modulus of more than 1 200 g/d.

In the present invention, due to the use of high pressure and a thin spinneret having spinneret orifices with a proper length/diameter ratio, the volume flow rate for a single orifice can be up to 2.5~5 ml/min, so that the high-strength and high-modulus polyethylene is obtained and meanwhile the spinning efficiency is improved greatly.

BRIEF DESCRIPTION OF THE DRAWING

FIG. 1 is a schematic cross-section view illustrating spinneret orifices in a multi-orifice thin spinneret according to an embodiment of the present invention.

PREFERRED EMBODIMENTS OF THE INVENTION

It is an object of the invention to provide a process for producing low-titer, high-strength and high-modulus polyethylene fiber with the spinning efficiency being improved. In this process, firstly, ultra-high molecular weight polyethylene ($Mw=2.5\times10^6\sim5\times10^6$) is dissolved in paraffin oil with a low viscosity of 6.5~7.5 to form a spinning solution with a concentration of 3~15%, preferably 6~10%. Then, a high pressure of 2.5±1.0 MPa is applied to the spinning solution, so that the spinning solution is extruded through a thin spinneret at a volume flow rate for a single orifice of 2.5~5 ml/min. The number of the orifices in the thin spinneret is at least 10 f, the orifice diameter is 0.7~0.8 mm and the length/diameter ratio (L/D) of the orifice is 10~12. In some embodiments, the number of the orifice is 10, 50, 80, 200, or 240 f. In some embodiments, the diameter of the orifice is 0.7, 0.71, 0.72, 0.75, 0.78, or 8.0 mm, and the length/diameter ratio (L/D) is 10, 10.3, 10.5, 11, 11.5, or 12. At this time, the shear rate of the fluid is in the range of 200~3500 $sec^{-1}$, such as 200, 250, 300, 500, 1 000, 1 200, 1 500, 2 000, 2 500, 3 000, 3 300, or 3 500 $sec^{-1}$. Furthermore, a jet stretch is preformed on the extruded fluid at a deformation rate of 200~5 000 $min^{-1}$ within an air-gap of 10~15 mm. In some embodiments, the air-gap is 10, 10.5, 11, 12, 13, 14 or 15 mm. In some embodiments, the deformation rate is 200, 500, 700, 800, 1 000, 1 500, 1 800, 2 000, 3 000, 3 500, 4 000, 4 500, 4 800 or 5 000 $min^{-1}$.

The length/diameter ratio (L/D) is a ratio of the length L to the diameter D of the spinneret orifice. In order to describe the ratio L/D, FIG. 1 illustrates a schematic cross-section view of spinneret orifices in a multi-orifice thin spinneret according to an embodiment of the present invention. As shown in FIG. 1, the orifice is composed of a leading hole 1 and a spinning hole 2. Compared with the embodiment proposed in WO 2005/066401A, the length of the leading hole in the present invention is very short. Therefore, the spinneret of the present invention can be thin. Herein, the length L in the ratio L/D is the length of the spinning hole 2, and the diameter D in the ratio L/D is the diameter of the spinning hole 2.

In order to obtain a shear rate of the fluid in the range of 200~3 500 $sec^{-1}$, the following means are taken in the process by the present invention:

(1) Increasing the Spinning Pressure, and Improving the Spinning Efficiency

In general, when a fluid flows through a capillary with a diameter of R, a shear will generate between the fluid and the capillary wall. The shear stress on the fluid can be represented by the following equation:

$$\sigma_{rz} = \frac{\partial P}{\partial Z} \cdot \frac{r}{2} \tag{1}$$

wherein $\sigma_{rz}$ is the shear stress on the fluid at the diameter of r along the flowing direction;

$$\frac{\partial P}{\partial Z}$$

denotes the variation of the pressure depending on the sub-direction of flowing.

The maximum shear stress on the fluid at the capillary wall can be calculated from the equation (1) as $$\sigma_{rz}|_{r=R} = \frac{\partial P}{\partial Z} \cdot \frac{r}{2} \tag{2}$$

The relationship between the apparent shear viscosity $\eta_a$ of the fluid and the shear stress on the tube walls $\sigma_w$, the shear rate $\gamma_n$ as the fluid flows through the capillary can be shown as follows:

$$\eta_a = \frac{\sigma_w}{\gamma_n} \tag{3}$$

It can be seen from the equation (1) that, the shear stress on the fluid is in direct proportion to the pressure, and therefore it is a good measure to improve the shear stress by increasing the spinning pressure; It can be seen from the equation (3) that, the apparent shear viscosity $\eta_a$ decreases as the shear rate increases.

In view of the high entanglement degree of macromolecular chain of ultra-high molecular weight polyethylene, the present invention employs a process comprising a pre-swelling of the polymer, and a continuous dissolution and deaeration in a twin screw extruder, thereby obtaining a solution with a high viscosity. Then, a high pressure (1.5~4.5 MPa) is provided for the spinning by the twin screw extruder with a strong output power, and under this pressure, the spinning efficiency is improved considerably.

The increase of the shear stress due to the increase of the spinning pressure not only facilitates the disentanglement of the ultra-high molecular weight macromolecular chains, the decrease of the apparent viscosity, and thereby the smooth progression of the spinning, but also makes the orientation of the macromolecular chains align with the extruding direction, which will facilitate the subsequent jet stretch and thermal stretch of gel filament.

(2) Increasing the Shear Rate of the Fluid, and Further Disentangling the Macromolecular Chains The disentanglement state of the macromolecular chains of ultra-high molecular weight polyethylene in solution is in a dynamic balance, and a high shear rate of the fluid can impart a high shear stress on the macromolecular chains, and therefore will facilitate the further disentanglement of the macromolecular chains. In the present invention, a shear rate of 200~2 200 $sec^{-1}$ for the solution can be achieved with a small orifice diameter of 0.7~0.8 mm and a high extruding flow rate of 2.5~5 ml/min for a single orifice. The reasons are as follows:

According to the study on the rheological property of a semi-dilute solution of ultra-high molecular weight polyethylene (see Kequan Chen and Anqiu Zhang etc., Synthetic Fiber Industry, Vol. 11, No. 5, P 41, 1988, for details), the shear rate γ of such a pseudoplastic non Newtonian fluid in a capillary can be shown as follows:

$$\gamma = \frac{3n+1}{4n}\gamma_n \tag{4}$$

$$n = \frac{d\ln P}{d\ln\gamma_n} \tag{5}$$

$$\gamma_n = \frac{4Q}{\pi R^3} = \frac{4}{R}V_0 \tag{6}$$

$$P = 2\sigma\frac{L_0}{R_0} + 2\sigma e \text{ wherein } \left(e = s + \frac{\gamma_e}{2}\right) \tag{7}$$

$$\sigma_{11} - \sigma_{22} = \sigma\gamma_e \tag{8}$$

wherein $\gamma_n$ is a shear rate of Newtonian fluid; n is a non Newtonian index; P is an extruding pressure; Q is an extruding volume flow rate; R and D are a radius and a diameter of a orifice, respectively; $V_0$ is an extruding velocity; e is an end core value; $\sigma_{11}$-$\sigma_{22}$ is the first normal stress difference; and $\gamma_e$ is recoverable elastic deformation.

Therefore, in the present invention, a fluid shear rate of 200~3 500 $sec^{-1}$ can be achieved by selecting a extruding rate and an orifice radius within the above ranges.

In the present invention, the fluid shear rate is preferably in the range of 800~2 000 $sec^{-1}$.

The following equation (9) can be obtained by introducing the equation (6) into the equation (4):

$$\gamma = \frac{3n+1}{4n}\cdot\frac{4Q}{\pi R^3} \tag{9}$$

It can be seen from the equation (9) that, increasing the volume flow rate Q and decreasing the orifice radius will increase the fluid shear rate greatly, which means that 1) it is a direct means to increase the fluid shear rate; and 2) it is an effective way to lower the apparent viscosity of a solution. Thus, both are beneficial to the progress of spinning.

Therefore, in the present invention, a fluid shear rate of 200~3 500 $sec^{-1}$ can be achieved by selecting a high pressure of 2.5±1.0 MPa, a orifice diameter ϕ of 0.7~0.8 mm, and a length/diameter ratio L/D of 10~12.

(3) Increasing the Deformation Rate of the Jet Stretch

It can be seen from the equation (8) that, the shear stress is in direct proportion to the first normal stress difference, which is the main reason for die swell. In order to reduce the titer of finished fibers, it is necessary to perform a jet stretch to compensate the negative effect of the die swell.

The following equation (10) can be concluded from the definition of the deformation rate:

$$\acute{\epsilon}=(\lambda-1)V_0/H \tag{10}$$

wherein $\acute{\epsilon}$ is the deformation rate of jet stretch; λ is a stretch ratio; H is an air-gap for the jet stretch; $V_0$ is the extruding rate.

It can be seen from the equation (10) that, the deformation rate is in direct proportion to the (λ−1) and the extruding rate $V_0$, but is in inverse proportion to the air-gap H. In practical operation, increasing the extruding rate is a more effective way to increase the deformation rate.

Moreover, the stability of jet stretch is very important for the spinning process, and has a close relationship with the stretch circumstances, specifically, the controlling of the air-gap and the stretch atmosphere. In the present invention, the air-gap of jet stretch is the space between the spinneret and the quench bath surface, and the air-gap is preferably controlled to be 10~15 mm. The jet stretch can be performed in an atmosphere without gas convection, or in a hermetic space (for example, a gasket ring can be disposed between the spinneret and the quench bath to form a hermetic space).

Therefore, the deformation rate of jet stretch of the invention is preferably controlled to be 200~5 000 $min^{-1}$, and more preferably, 800~4 500 $min^{-1}$. Under this condition, a multi-stage stretch can be performed, the stretch ratio will be 15 or less, and the stability of jet stretch can be achieved easily.

Preferably, the air-gap is 15 mm, so as to avoid the change of the deformation rate caused by the fluctuation of the air-gap.

In the third step of the process for producing low-titer, high-strength and high-modulus polyethylene fiber according to an embodiment of the present invention, the jet-stretched fluid is to be cooled by a quench bath to form gel filaments. In this step, it is important to form steady gel filaments. Gel filaments with high quality can be formed from the jet-stretched fluid only under uniform, quenching conditions. Herein, the temperature of the quench bath is preferably controlled to be 8~14° C., the quench bath passes though the fluid to be cooled at a rate of 2 m/min, further, and a cationic surfactant such as dodecyl trimethyl ammonium chloride can be added into the quench bath to accelerate the escape of the solvent in the filament.

In the fourth step of the process for producing low-titer, high-strength and high-modulus polyethylene fiber according to an embodiment of the present invention, the extractant used in this step is an environment-friendly extractant. Compared with WO 01/73173A, the present invention employs, as an extractant, an Solvent Naphtha which is miscible with spinning solvent such as white oil, has a boiling point of 80~120° C., and is composed of alkane compounds with low carbon chains, and a multi-stage extraction is carried out at a temperature of 60° C. or less.

Since the extractant and the components of the white oil are homologues, they can be separated from each other by a simple separation method, and then can be reused. Further, alkane compounds are environment-friendly compounds.

In the fifth step of the process for producing low-titer, high-strength and high-modulus polyethylene fiber according to an embodiment of the present invention, a multistage ultrahigh post stretch with low stretch ratios is performed. That is, a multi-stage (preferably four-stage) thermal stretch is performed on the extracted and dried gel filaments, and the total post-stretch ratio is 15 or less. In a preferred embodiment, the preferred four-stage thermal stretch comprises: a stretch with a stretch ratio of 6~8 is performed at a temperature of 110~125° at the first stage; a stretch with a stretch ratio of 1.3~1.5 is performed at a temperature of 120~130° at the second stage; a stretch with a stretch ratio of 1.3~1.5 is performed at a temperature of 120~130° at the third stage; and a stretch with a stretch ratio of 1.1~1.2 is performed at a temperature of 130~140° at the fourth stage.

Thus, in some embodiments of the present invention, there is provided high-strength and high-modulus polyethylene fiber which has a denier per filament of less than 2 d, a strength of more than 35 g/d and a modulus of more than 1 000 g/d. In other embodiments of the present invention, there is even provided high-strength and high-modulus polyethylene fiber which has a denier per filament of less than 1.5 d, a strength of more than 38 g/d and a modulus of more than 1 200 g/d.

In the present invention, when the spinning solution flows through the spinneret with small aperture under the condition of applying high pressure to the solution, macromolecular chains are sheared, disentangled and orientated, and this further disentangling and orientating makes tensile properties of the resulting gel filament be improved considerably.

Furthermore, in the process of the present invention, a volume flow rate of 2.5~5 ml/min for a single orifice can be achieved by using high pressure and a thin spinneret with a proper length/diameter ratio, and thereby the spinning efficiency can be improved.

EXAMPLES

The invention will be further described in more details with reference to the specific examples. It should be noted that the following examples are only demonstrative, and are not intended to limit the scope of the invention in any way.

Example 1

Ultra-high molecular weight polyethylene (GUR-4022, Mw=350×10$^4$) is placed into paraffin oil with a low viscosity η of 7.5 (available from Sinopec Jinling Petrochemical Corp., Ltd.) to pre-swell, so as to form a suspension of the ultra-high molecular weight polyethylene, in which the concentration of the ultra-high molecular weight polyethylene is 8%, and the ultra-high molecular weight polyethylene is partially swollen. Next, the suspension is fed into a co-rotating parallel twin-screw extruder (available from Nanjing Ruiya Polymer Processing Equipment Co., Ltd, ϕ=2×65 mm, L/D=68, rotation velocity N=350 rpm) and is subjected to rapid dissolution and continuous deaeration. Spinning conditions are as follows: the extruding pressure is 2.5 MPa, the orifice diameter (0) of the spinneret is 0.7 mm, the length/diameter ratio of the spinneret orifice is 10, the number of the spinneret orifice is 80 f, the volume flow rate for a single orifice is 3.75 ml/min, the solution extruding rate is 9.749 m/min, the fluid shear rate is 1 857 sec$^{-1}$, the jet stretch ratio is 7.2 within an air-gap of 15 mm, the deformation rate of jet stretch is 4 030 min$^{-1}$. The extruded fluid passes through the quench bath to form the gel filaments, wherein the quench bath is an aqueous solution containing a cationic surfactant such as dodecyl trimethyl ammonium chloride and the temperature of the quench bath is kept at 8~14° C., followed by being initially drafted at room temperature to provide gel fibers to be stretched.

The above gel fibers are subjected to three-stage extraction using 120# Solvent Naphtha (available from China Petroleum & Chemical Corporation, Baling Branch) as an extractant at room temperature, and thereby the white oil is replaced by the Solvent Naphtha; the gel fibers containing the Solvent Naphtha are subjected to two-stage drying, i.e., at room temperature and at 60° C., respectively; the dried gel fibers are subjected to four-stage ultrahigh post stretch at a temperature of 110~140° C., wherein the stretch ratio is 1.06 at each stage, and the total stretch ratio is 15 or less. The resulting fibers are subjected to mechanical test according to ISO2062-1993, and the results are shown in table 1.

Example 2

The dissolution and continuous deaeration procedure is the same as that of Example 1 except that the ultra-high molecular weight polyethylene (Mw=3.0×10$^6$) is purchased from Sinopec Jinling Petrochemical Corp., Ltd.

Spinning conditions are as follows: the extruding pressure is 3.5 MPa, the orifice diameter (ϕ) of the spinneret is 0.8 mm, the length/diameter ratio of the spinneret orifice is 12, the number of the spinneret orifice is 240 f, the volume flow rate for a single orifice is 4.37 ml/min, the solution extruding rate is 8.708 m/min, the fluid shear rate is 1 449 sec$^{-1}$, the stretch ratio is 6 within an air-gap of 15 mm, the deformation rate of the jet stretch is 3 309 min$^{-1}$; and the subsequent formation, extraction and stretch of the gel filaments are the same as those of Example 1. The resulting fibers are subjected to mechanical test according to ISO2062-1993, and the results are shown in table 1.

Comparative Example 1

The dissolution and continuous deaeration procedure is the same as that of Example 1 except that the ultra-high molecular weight polyethylene (Mw=2.5×10$^6$) is purchased from Sinopec Jinling Petrochemical Corp., Ltd.

Spinning conditions are as follows: the extruding pressure is 3.0 MPa, the orifice diameter (ϕ) of the spinneret is 0.8 mm, the length/diameter ratio of the spinneret orifice is 10, the number of the spinneret orifice is 80 f, the volume flow rate of a single orifice is 2.75 ml/min, the solution extruding rate is 6.720 m/min, the fluid shear rate is 1 281.3 sec$^{-1}$, the stretch ratio is 1.1 with an air-gap of 15 mm, the deformation rate of the jet stretch is only 44.8 min$^{-1}$; and the subsequent formation, extraction and stretch of the gel filaments are the same as those of Example 1. The mechanical properties of the resulting fibers are shown in table 1.

TABLE 1

| | Example 1 | Example 2 | Comparative Example 1 |
|---|---|---|---|
| UHMW-PE weight-average molecular weight | 350 × 10$^4$ | 300 × 10$^4$ | 250 × 10$^4$ |
| Concentration (%) | 8 | 8 | 8 |
| Twin-screw (mm) | 2 × 56 | 2 × 56 | 2 × 56 |
| Diameter of orifice (mm) | 0.7 | 0.8 | 0.8 |
| Number of orifice (f) | 80 | 240 | 80 |
| Extruding flow rate for a single orifice (ml/min) | 3.75 | 4.37 | 2.07 |
| Extruding rate (m/min) | 9.749 | 8.708 | 6.720 |
| Jet stretch ratio | 7.2 | 6.7 | 1.1 |
| Shear rate (sec$^{-1}$) | 1 857 | 1 449 | 1 281.3 |
| Deformation rate of the jet stretch (min$^{-1}$) | 4 030 | 3 309 | 44.8 |
| Total denier (dtex/d) | 167/150 | 331/299 | 1 031/929 |
| Denier per filament (dtex/d) | 2.09/1.88 | 1.39/1.25 | 14.3/12.9 |
| Tensile strength (g/d) | 38.8 | 35.75 | 30 |
| Modulus (g/d) | 1 271.6 | 1 221 | 788 |
| Elongation (%) | 3.02 | 3.2 | 4.6 |

The invention claimed is:

1. A process for producing low-titer, high-strength and high-modulus polyethylene fiber, comprising the following steps:

a). dissolving the ultra-high molecular weight polyethylene with Mw of 2.5×10$^6$~5×10$^6$ into paraffin oil with a low viscosity of 6.5~7.5 mm$^2$/sto form a spinning solution with a concentration of 3~15%;

b). extruding the spinning solution through a thin spinneret with at least 10 orifices, each orifice having a leading hole and a spinning hole, a diameter Φ of 0.7~0.8 mm and a length/diameter ratio of the spinning hole of 10~12, by applying a high pressure in the range of 2.5±1.0 MPa to the spinning solution, such that the fluid in the orifices is extruded at a shear rate of above 200 $sec^{-1}$ and not above 3 500 $sec^{-1}$, wherein the extruding flow rate for a single orifice is 2.5~5 ml/min; and then performing a jet stretch at a deformation rate of 200~5 000 $min^{-1}$ within an air-gap of 10~15 mm between the spinneret and the quench bath surface;

c). feeding the jet-stretched fluid into the quench bath to form gel filaments;

d). extracting and drying the gel filaments; and e). performing a multistage ultrahigh post stretch on the dried gel filaments with a stretch ratio of 15 or less.

2. The process for producing low-titer, high-strength and high-modulus polyethylene fiber according to claim 1, wherein the shear rate is 800~2 200 $sec^{-1}$.

3. The process for producing low-titer, high-strength and high-modulus polyethylene fiber according to claim 1, wherein the deformation rate is 800~4 500 $min^{-1}$.

4. The process for producing low-titer, high-strength and high-modulus polyethylene fiber according to claim 1, wherein the air gap is 15 mm.

5. The process for producing low-titer, high-strength and high-modulus polyethylene fiber according to claim 1, wherein in the step b), the number of the orifices is at least 80f.

6. The process for producing low-titer, high-strength and high-modulus polyethylene fiber according to claim 1, wherein in the step a), a spinning solution with a concentration of 6~10% is formed.

7. The process for producing low-titer, high-strength and high-modulus polyethylene fiber according to claim 1, wherein the quench bath is an aqueous solution containing a cationic surfactant.

8. The process for producing low-titer, high-strength and high-modulus polyethylene fiber according to claim 1, wherein 120# Solvent Naphtha is used as an extractant for multistage extraction and drying.

9. The process for producing low-titer, high-strength and high-modulus polyethylene fiber according to claim 1, wherein the multistage ultrahigh post stretch is a four-stage stretch with a stretch ratio of 15 or less.

10. The process for producing low-titer, high-strength and high-modulus polyethylene fiber according to claim 1, wherein the resulting low-titer, high-strength and high-modulus polyethylene fiber has a denier per filament of less than 2 d, a strength of more than 35 g/d and a modulus of more than 1000 g/d.

* * * * *